United States Patent [19]

Takahashi et al.

[11] Patent Number: 4,994,120

[45] Date of Patent: Feb. 19, 1991

[54] PROCESS FOR PRODUCTION OF GRAIN ORIENTED ELECTRICAL STEEL SHEET HAVING HIGH FLUX DENSITY

[75] Inventors: Nobuyuki Takahashi; Yozo Suga; Katsuro Kuroki; Satoshi Arai, all of Kitakyushu, Japan

[73] Assignee: Nippon Steel Corporation, Tokyo, Japan

[21] Appl. No.: 274,432

[22] Filed: Nov. 18, 1988

[30] Foreign Application Priority Data

| | | | |
|---|---|---|---|
| Nov. 20, 1987 | [JP] | Japan | 62-291975 |
| May 7, 1988 | [JP] | Japan | 63-109880 |
| May 11, 1988 | [JP] | Japan | 63-112551 |

[51] Int. Cl.[5] ..... H01F 1/04

[52] U.S. Cl. ..... 148/111

[58] Field of Search ..... 148/111

[56] References Cited

U.S. PATENT DOCUMENTS

| | | | |
|---|---|---|---|
| 3,932,234 | 1/1976 | Imanaka et al. | 148/111 |
| 4,171,994 | 10/1979 | Miller, Jr. | 148/111 |

*Primary Examiner*—Melvyn J. Andrews

*Attorney, Agent, or Firm*—Kenyon & Kenyon

[57] ABSTRACT

Disclosed is a process for the preparation of a grain oriented electrical steel sheet having a high flux desnity, which comprises hot-rolling a slab comprising 1.5 to 4.8% by weight of Si, 0.012 to 0.050 by weight of acid-soluble Al, up to 0.012% by weight of at least one member selected from S and Se, 0.0010 to 0.0120% by weight of N, Mn in an amount of up to 0.45% by weight which satisfies the requirement of $Mn/(S+Se) \geqq 4.0$ and 0.005 to 0.0080% by weight of B, with the balance comprising Fe and unavoidable impurities, and optionally, further comprising 0.0020 to 0.0120% by weight of Ti, performing cold rolling once or at least twice with intermediate annealing to obtain a final thickness, performing decarburization annealing in a wet hydrogen atomsphere, coating an annealing separator on the steel sheet surface, performing finish annealing for a secondary recrystallization and purification of the steel, and performing a nitriding treatment during the period of from the point of termination of final cold rolling to the point of initiation of secondary recrystallization at the finish annealing step. Furthermore, the above-mentioned slab is heated at a temperature lower than 1200° C. before the hot rolling step, and even in the production of a thin product having a thickness of 0.10 to 0.23 mm, a high flux density can be realized.

12 Claims, 8 Drawing Sheets

6/8

8/8

PROCESS FOR PRODUCTION OF GRAIN ORIENTED ELECTRICAL STEEL SHEET HAVING HIGH FLUX DENSITY

BACKGROUND OF THE INVENTION

1. Field of the Invention

The present invention relates to a process for the production of a grain oriented electrical steel sheet used as an iron core of an electric appliance. More particularly, the present invention relates to a process in which the slab-heating temperature is lower than 1200° C., i.e., a production process in which an inhibitor is formed after the completion of cold rolling, where a product having a high flux density can be prepared even from a material having a high Si content.

2. Description of the Prior Art

A grain oriented electrical steel sheet is composed of crystal grains having a Goss orientation having a <001> axis in the rolling direction on the {110} plane [expressed as orientation {110}<001> by Miller indices], and is used as a soft magnetic material for an iron core of a transformer or electric appliance.

This steel sheet should have excellent magnetic characteristics such as magnetization and iron loss characteristics, but whether or not the magnetization characteristics are good depends on the density of the magnetic flux induced in an iron core under the magnetic field applied, and if a product having a high flux density (grain oriented electrical steel sheet) is used, the size of the iron core can be diminished.

A steel sheet having a high flux density can be obtained by an optimum arrangement of the orientation of crystal grains in {110}<001>.

The term, iron loss, refers to the loss of power consumed as heat energy when an alternating magnetic field is applied to the iron core, and whether or not the iron loss characteristic depends on the flux density, the sheet thickness, the impurity content in the steel, the resistivity, the crystal grain size, and the like.

A steel sheet having a high flux density is preferred because the size of the iron core of an electric appliance can be diminished and the iron loss can be reduced, and therefore, development of a process for preparing a product having as high as possible a flux density, at a low cost, is urgently required in the art.

A grain oriented electrical steel sheet is prepared according to the secondary recrystallization process, in which a hot-rolled sheet obtained by hot-rolling a slab is subjected to an appropriate combination of cold rolling and annealing to form a steel sheet having a final thickness, and subjecting the steel sheet to finish annealing to selectively grow primary recrystallized grains having an orientation {110}<001>, i.e., secondary recrystallization.

The presence of fine precipitates, for example, MnS, AlN, MnSe, (Al, Si)N, and $Cu_2S$, and intergranular elements such as Sn and Sb in the steel sheet before secondary recrystallization is indispensable for the attainment of a secondary recrystallization. As explained by J. E. May and D. Turnbull [Trans. Met. Soc. AIME 212 (1958), pages 769–781], these precipitates and intergranular elements exert a function of selectively growing grains having an orientation {110}<001> while controlling the growth of primary recrystallized grains in an azumith other than the orientation {110}<001> at the finish annealing step.

This effect of controlling the growth of grains is generally called the inhibitor effect.

Accordingly, an important problem in the research in the art is how to clarify what precipitate or intergranular element should be used for stabilizing a secondary recrystallization, or how an appropriate presence state of the precipitate or intergranular element should be attained for increasing the presence ratio of grains having a precise orientation {110}<001>.

Since a high degree of control of the orientation {110}<001> is limited by the use of one kind of precipitate, development of a technique for preparing a product having a high flux density, stably and at a low cost, is now under serious study involving an examination of the merits and demerits of various precipitates and an organical combination of several precipitates.

Regarding the kind of precipitates, MnS is reported by N. F. Littmann in Japanese Examined Patent Publication No. 30-3651 and J. E. May and D. Turnbull in Trans. Met. Soc. AIME 212 (1958), pages 769–781, AlN and MnS are reported by Taguchi and Sakakura in Japanese Examined Patent Publication No. 33-4710, VN is reported by Fiedler in Trans. Met. Soc. AIME 221 (1961), pages 1201–1205, MnSe and Sb are reported by Imanaka et al in Japanese Examined Patent Publication No. 51-13469, AlN and copper sulfide are reported by J. A. Salsgiver et al in Japanese Examined Patent Publication No. 57-45818, and (Al, Si)N is reported by Komatsu et al in Japanese Examined Patent Publication No. 62-45285. Furthermore, TiS, CrS, CrC, NbC and $SiO_2$ are known.

As the intergranular element, As, Sn and Sb are reported by Tatsuo Saito in Journal of the Japan Institute of Metals, 27 (1963), page 186, but these elements are not used alone in the industrial production and are used in combination with precipitates, with a view to attaining an auxiliary effect.

Characteristic inhibitors are disclosed by H. Grenoble in U.S. Pat. No. 3,905,842 (1975) and by H. Fiedler in U.S. Pat. No. 3,905,843 (1975). Namely, the production of a grain oriented electrical steel sheet having a high flux density is made possible by the presence of an appropriate amount of solid-dissolved S, B and N.

The standard for selection of a precipitate effective for the secondary recrystallization has not been completely clarified, but a typical opinion is stated by Matsuoka in, Iron and Steel, 53 (1967), pages 1007–1023. This opinion is summarized below.

(1) The size should be about 0.1 μm.

(2) The necessary volume is at least 0.1% by volume.

(3) The precipitate should not be completely dissolved or should not be completely insoluble in the secondary recrystallization temperature but should be solid-soluble to an appropriate extent.

The above-mentioned various precipitates satisfy some but not all of these requirements. In the process of the present invention, where the steel plate is nitrided after the cold-rolling step, the requirement (1) is of no significance.

As pointed out hereinbefore, a guidance principle for selection of a precipitate has not been established, and a search for a new technique for controlling an inhibitor has been made by trial and error.

To obtain a high flux density [high integration degree of orientation {110}<001>], a large quantity of a fine and uniform precipitate must be present in a steel plate before finish annealing, and the properties before the secondary recrystallization must be adjusted by not only control of the precipitate but also an appropriate combination of the rolling and heat treatment in compliance with the characteristics of the precipitate.

Three typical processes are now adopted for the industrial production of unidirectional electromagnetic steels, and each has merits and demerits.

The first process is a two-cold-rolling process using MnS as the inhibitor, which is proposed by M. F. Littmann in Japanese Examined Patent Publication No. 30-3651. According to this process, secondary recrystallized grains are stably grown, but a product having a high flux density cannot be obtained.

The second process is a one-cold-rolling process in which (AlN+MnS) is used as the inhibitor and final cold rolling is carried out under a high reduction ratio exceeding 80%, as proposed by Taguchi and Sakakura in Japanese Examined Patent Publication No. 40-15644. According to this process, a product having a very high flux density can be obtained, but in industrial production, the preparation conditions must be strictly controlled.

The third process is a two-cold-rolling process in which [MnS (and/or MnSe)+Sb] is used as the inhibitor, as proposed by Imanaka et al in Japanese Examined Patent Publication No. 51-13461. According to this process, a relatively high flux density can be obtained, but since poisonous and expensive elements such as Sb and Se are used, and cold rolling is conducted twice, the manufacturing cost is high.

These three processes have the following problem in common. Namely, in each of these processes, to form a fine and uniform precipitate, the precipitate must be once solid-dissolved, and therefore, the slab-heating temperature must be high.

Note, in the first process the slab-heating temperature is higher than 1260° C., and in the second process, as disclosed in Japanese Unexamined Patent Publication No. 48-51852, the slab-heating temperature differs according to the Si content in the material: where the Si content is 3%, the slab-heating temperature is 1350° C. In the third process, as taught in Japanese Unexamined Patent Publication No. 51-20716, the slab-heating temperature is higher than 1230° C., and in the example where a high flux density is obtained, the slab-heating temperature is as high as 1320° C.

Namely, a slab is heated at a high temperature to solid-dissolve the precipitate and is precipitated again during the subsequent hot-rolling or heat-treating step.

Since the slab-heating temperature is high, the consumption of energy for heating is increased and the yield is reduced by slag formation. Moreover, problems arise such as an increase of the cost of repairing a heating furnace and reduction of the operation rate of the equipment. Furthermore, as taught in Japanese Examined Patent Publication No. 57-41526, a linear secondary recrystallization-insufficient portion is formed if the slab-heating temperature is high, and therefore, a continuously cast slab cannot be used.

In addition to the above-mentioned cost problem, there is another serious problem. Namely, if an iron loss-reducing means such as an increase of the Si content or reduction of the thickness of the product is adopted, the above-mentioned linear secondary recrystallization-insufficient portion is conspicuously formed and future improvement of the iron loss characteristics cannot be gained in the process in which a slab must be heated at a high temperature.

As a means for solving such problems, Japanese Examined Patent publication No. 61-60896 proposes a process in which the secondary recrystallization is greatly stabilized by reducing the S content in steel, and an increase of the Si content and a reduction of the thickness become possible.

Furthermore, there can be mentioned a process proposed by H. Grenoble in U.S. Pat. No. 3,905,842 and a process proposed by H. Fiedler in U.S. Pat. No. 3,905,843. These processes, however, include substantial contradictions and are not industrially worked. Namely, according to this technique, since the inhibitor is composed mainly of solid-dissolved S, to maintain solid-dissolved S, the Mn content must be reduced so as not to form MnS. More specifically, a requirement of $Mn/S \leqq 2.1$ must be satisfied. But, as is well-known, solid-dissolved S has a bad influence on the toughness of the material, and accordingly, in the unidirectional electromagnetic steel plate which has a high Si content and is easily cracked, it is very difficult in industrial production to cold-roll a material containing such solid-dissolved S.

As pointed out hereinbefore, to make it possible to produce a thin product having a high flux density and a high Si content, in which a reduction of the iron loss will be possible in the future, a reconstruction of the inhibitor design is necessary. Moreover, to obtain a product having a high flux density stably, it is necessary to eliminate the unstability due to the preparation conditions. Where one preparation condition, for example, the reduction ratio at the cold rolling step, is set, if a reduction of allowable ranges of other conditions for obtaining a product having a high flux density, for example, the cooling condition at the step of annealing the hot-rolled sheet and the decarburization annealing temperature condition, is caused, this will be disadvantageous for the production of an electrical steel sheet and will result in a reduction of the yield. Broadening of the allowable ranges of these conditions is very important to enable a stable industrial production.

The technical object of the present invention is to solve these problems.

SUMMARY OF THE INVENTION

A primary object of the present invention is to obtain a high flux density by making a large quantity of a fine and uniform precipitate present in a steel sheet before the initiation of secondary recrystallization and to prepare a grain oriented electrical steel sheet having a high flux density by adjusting the properties before secondary recrystallization in compliance with the formed precipitate.

Another object of the present invention is to provide a process for preparing a product having a high flux density by performing the slab heating at a low temperature such as adopted for an ordinary steel while reducing the occurrence of rolling cracking.

The present inventors carried out research into ways of overcoming the defects of the conventional techniques and attaining the foregoing objects, and as a result, found that an electrical steel sheet having a high flux density can be obtained stably over a broad range of the reduction ratio at the cold rolling step by controlling the amount of S and/or Se in molten steel below a certain level, cold-rolling once or at least twice a material having appropriate amounts of Al, N and B or a combination of B and Ti incorporated therein under conditions such that the amount of solid-dissolved S or Se is reduced, to form a steel sheet having a final thickness, performing decarburization annealing, coating the steel with an annealing separator, conducting finish annealing, and performing a nitriding treatment of the steel sheet during the period of from the point of completion of final cold rolling to the point of secondary recrystallization at the finish annealing step.

More specifically, in accordance with the present invention, there is provided a process for the preparation of a grain oriented electrical steel sheet having a high flux density, which comprises hot-rolling a slab comprising 1.5 to 4.8% by weight of Si, 0.012 to 0.050% by weight of acid-soluble Al, up to 0.012% by weight of at least one member selected from S and Se, 0.0010 to 0.0120% by weight of N, Mn in an amount of up to 0.45% by weight which satisfies the requirement of $Mn/(S+Se) \geqq 4.0$ and 0.0005 to 0.0080% by weight of B, with the balance comprising Fe and unavoidable impurities, and optionally further comprising 0.0020 to 0.0120% by weight of Ti, performing cold rolling once or at least twice with intermediate annealing to obtain a final thickness, performing decarburization annealing in a wet hydrogen atmosphere, coating an anneal-separator on the steel sheet surface, performing finish annealing for a secondary recrystallization and purification of the steel, and performing a nitriding treatment of the steel sheet during the period of from the point of termination of final cold rolling to the point of initiation of secondary recrystallization at the finish annealing step. Furthermore, the above-mentioned slab is heated at a temperature lower than 1200° C. before the hot rolling step. Moreover, according to the present invention, in the production of a thin product having a thickness of 0.10 to 0.23 mm, a high flux density can be realized.

DESCRIPTION OF THE PREFERRED EMBODIMENTS

The structural requirements characterizing the present invention will now be described with reference to embodiments directed to a single addition of B.

If the Si content in the steel is excessively high, a linear secondary recrystallization-insufficient portion is conspicuously formed in the length direction of the product (strip), and a stable production is impossible. This tendency is especially prominent when the Si content exceeds 3.2% or in the case of a thin product having a thickness smaller than 0.23 mm (9 mil). The content of (S+Se) should be set as one requirement for solving this problem.

More specifically, to completely prevent a formation of a linear secondary recrystallization-insufficient portion, the upper limit of the content of (S+Se) must be set at 0.012%. Even if this requirement is satisfied, preferably the content of (S+Se) is controlled to as low a level as possible. In the process of the present invention, the flux density is degraded at the S or Se content heretofore considered effective for increasing the flux density, and a lower S or Se content gives a product having a better flux density. Nevertheless, the lower limit of the content of at least one member selected from S and Se, that can be attained without excessive increase of the cost according to the presently available technique of the production of electric steel sheets, is ordinarily 0.0005% by weight.

In the present invention, it is intended to completely prevent cracking of the material during the hot rolling and cold rolling steps, to decrease the manufacturing cost, and to prevent cracking of the material, which is due to a degradation of the toughness of the material by solid-dissolved S, the requirement of $Mn/(S+Se) \geqq 4$ is set to fix minute amounts of S and Se as MnS and MnSe as much as possible.

Figure 1:
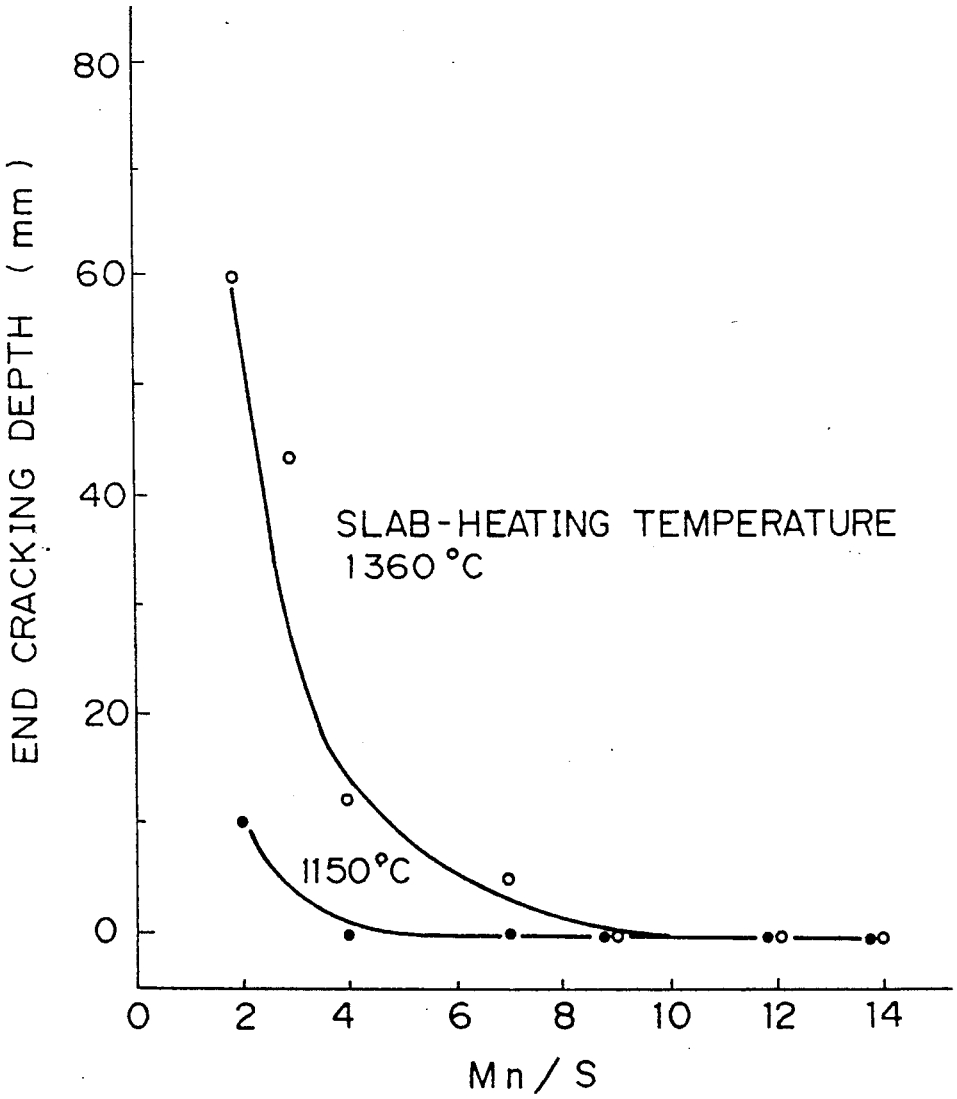
FIG. 1 is a diagram illustrating the relationship between the Mn/S ratio and the end cracking depth of the hot-rolled plate in one example of the present invention.

FIG. 1 shows the cracking states of end portions of hot-rolled sheets obtained by heating 50 kg of an ingot comprising 0.053% of C, 3.35% of Si, 0.030% of P, 0.030% of Al, 0.0075% of N, 0.0039% of B, 0.04 or 0.12% of Mn, and a variable amount of S at 1360° C. or 1150° C. and hot-rolling the steel. It is seen that, where $Mn/S \geqq 4$, cracking is drastically reduced, and especially in the case of a material in which the heating temperature is 1150° C. and solid dissolution of MnS does not occur, little cracking is caused.

As pointed out hereinbefore, the Mn content is determined relative to the content of (S+Se), and to prevent slivering in the hot-rolled sheet, only the requirement of $Mn/(S+Se) \geqq 4$ need be satisfied. Nevertheless, preferably the upper limit of the Mn content is 0.45%. If the Mn content exceeds 0.45%, a forsterite film defect appears in the product.

The effect attained by an addition of B will now be described.

A hot-rolled steel sheet having a thickness of 2.0 mm is prepared by heating 50 kg of an ingot comprising 0.053% of C, 3.27% of Si, 0.15% of Mn, 0.007% of S, 0.025% of P, 0.027% of Al, 0.0080% of N, and 0.0002 to 0.0095% of B, with the balance comprising Fe and unavoidable impurities, heated at 1150° C. and hot-rolling the steel. The hot-rolled sheet is annealed at 1120°

C. for 3 minutes and cold-rolled to a final thickness of 0.2 mm. Then, decarburization annealing is carried out at 810° C., 830° C., 850° C., 870° C., 890° C. or 910° C., and an anneal-separator composed mainly of MgO, which contains ferro-manganese nitride, is coated on steel and finish annealing is carried out. The results are shown in FIG. 2.

Figure 2:
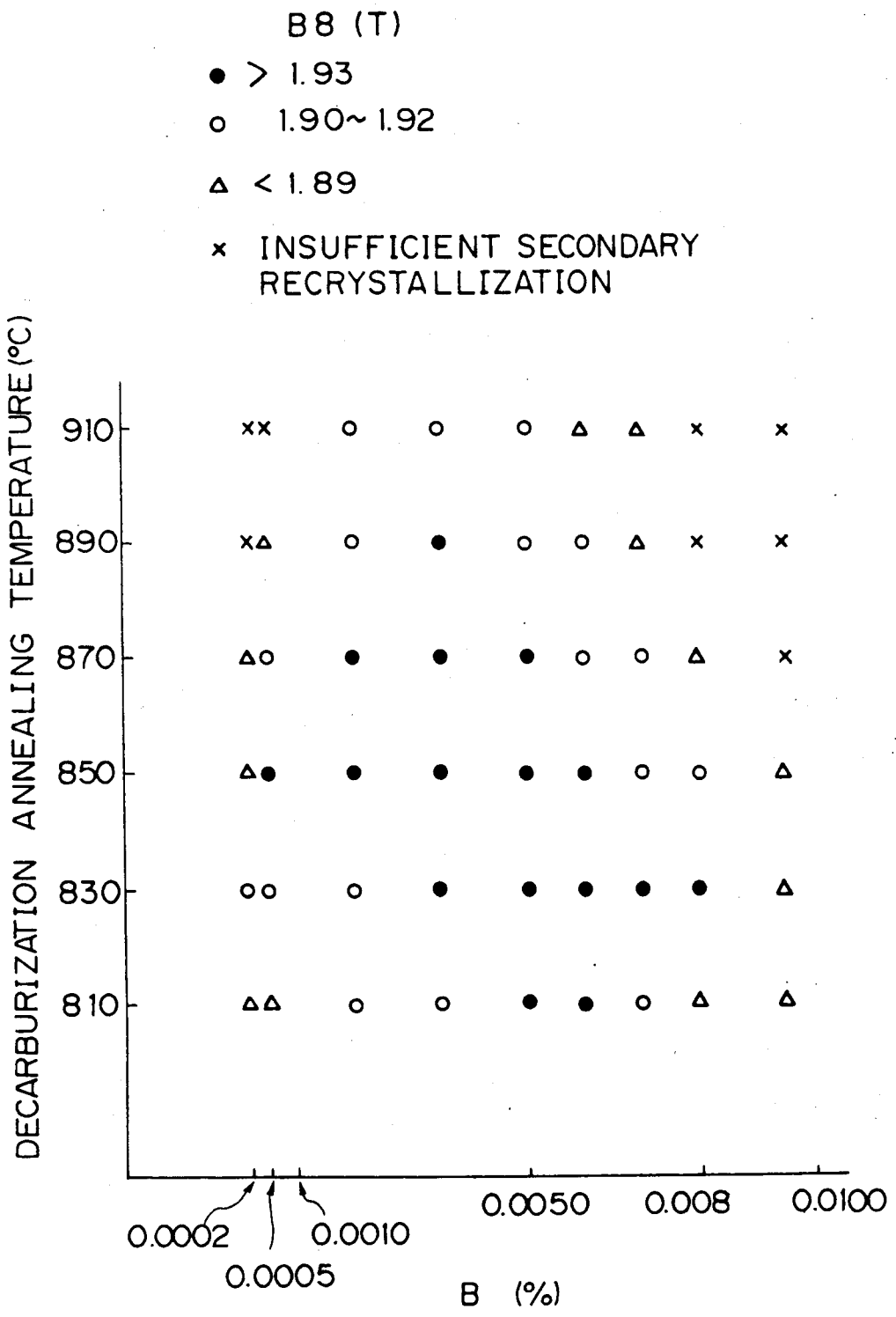
FIG. 2 is a diagram illustrating the influences of the relationship between the amount added of B and the decarburization annealing temperature on the flux density (B8) of the product in the same example.

As apparent from the results shown in FIG. 2, if the decarburization annealing temperature is high, the flux density of the product is increased, but at a low B content, fine grains are easily formed and the maximum value of B8 is small. On the other hand, if the B content is too high, a product having a large value of B8 cannot be obtained at some decarburization annealing temperature, and thus preferably the B content is in the range of from 0.0005 to 0.0080%.

This effect of an addition of B is significant where N is contained in an appropriate amount. It is considered that N probably exerts the effect in the form of BN. Namely, if the N content is lower than 0.001%, no effect is attained, and if the N content is higher than 0.0120%, blistering of the steel sheet occurs.

Al couples with N to form AlN. In the present invention, at the step after the final cold rolling step, the steel must be nitrided to form an Al-containing compound. Accordingly, the presence of free Al in an amount exceeding a certain level is necessary, and thus the Al content must be 0.012 to 0.050%.

If the slab-heating temperature is either a high temperature causing solid dissolution of the inhibitor, as adopted in the conventional technique, or a low temperature adopted for an ordinary steel, that is considered unadoptable in the conventional techniques, secondary recrystallization still occurs, but the slab-heating temperature is preferably lower than 1200° C. because this reduces cracking of side edge portions of the hot-rolled sheet, as shown in FIG. 1, the quantity of consumption of heat for heating the slab is reduced, the generation of slag is controlled, and the frequency or degree of repair of the furnace is reduced.

For cold rolling, the hot-rolled material is annealed for a short time to obtain a product having a highest flux density. If some reduction of the magnetic characteristics is tolerable, this annealing of the hot-rolled plate can be omitted, to reduce costs.

To reduce the grain size of the final product, cold rolling can be conducted at least twice, with intermediate annealing.

In one preferred embodiment of the present invention, the final sheet thickness is limited to 0.10 to 0.23 mm, for the following reason. As disclosed, for example, in Japanese Unexamined Patent Publication No. 57-41326, if the thickness is reduced, the eddy current loss is reduced but the hysteresis loss is increased. A specific thickness range exists wherein both factors are satisfactory and the iron loss is small, i.e., the range of from 0.10 to 0.23 mm.

In the present invention, an allowable range of the reduction ratio at the cold rolling step, where the secondary recrystallization is stable and a product having a high flux density is obtained, covers a higher reduction ratio, and therefore, the process of the present invention is advantageous for the production of such a thin product.

For example, to obtain a thin product having a thickness of 0.15 mm and a high flux density at a low cost by one cold rolling, a hot-rolled sheet having a thickness of 1.5 mm is necessary where B is not added, but hot rolling to a thickness of 1.5 mm on an industrial scale is very disadvantageous because the productivity is reduced and control is difficult.

As apparent from Example 3 given hereinafter, a high flux density can be obtained with a B-incorporated material even if the reduction ratio at the cold rolling step is as high as 93%, and a sheet having a high flux density can be obtained even from a hot-rolled sheet having a thickness of 2.0 mm by one cold rolling, and this process is advantageous for carrying out a stable industrial production.

After the final cold rolling, the material is subjected to decarburization annealing in an atmosphere of wet hydrogen or a mixture of wet hydrogen and nitrogen.

The decarburization annealing temperature is not particularly critical, but preferably is 800° to 900° C. The dew point of the atmosphere differs according to the hydrogen/nitrogen mixing ratio, but preferably is adjusted to a level higher than +30° C.

Then an anneal-separator is coated on the material, and finish annealing is carried out at a high temperature (generally, 1100° to 1200° C.) for a long time. The present invention is characterized in that an inhibitor necessary for the secondary recrystallization is formed in the steel by nitriding the steel during the period of from the point of completion of final cold rolling to the point of initiation of secondary recrystallization at the finish annealing step. According to one most preferred embodiment, the steel is nitrided during the elevation of the temperature for finish annealing. To realize this nitriding, an appropriate amount of a compound having a nitriding capacity, such as MnN or CrN, is added to the annealing separator, or a gas having a nitriding capacity, such as $NH_3$, is incorporated into the atmosphere gas.

In the process of the present invention, since the slab-heating temperature is low and below 1200° C., AlN and MnS precipitated in the coarse form at the casting step are not again solid-dissolved. Accordingly, an inhibitor for controlling the growth of grains formed by a primary recrystallization, which is obtained in the conventional processes, is not obtained. Therefore, according to the present invention, by nitriding the steel sheet after completion of cold rolling, AlN and (Al, Si)N are formed and act as the inhibitor.

Figure 8A:
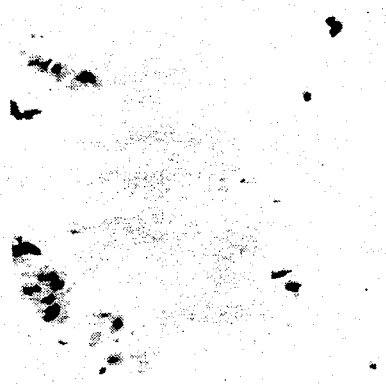
Figure 8B:
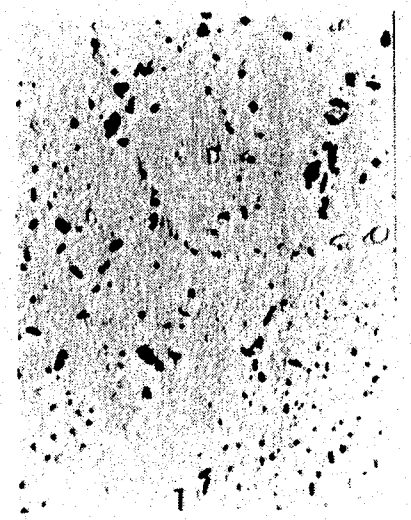

The state of formation of the inhibitor is observed with respect to a steel sheet (a) which has been subjected to decarburization annealing and a steel sheet (b) which is coated with an anneal-separator having MnN incorporated therein after decarburization annealing and heated at 1000° C. during the elevation of the temperature for finish annealing (at the initial stage of finish annealing, the steel sheet is nitrided by MnN). The results are shown in FIG. 8, wherein it is seen that, in the steel plate (b), the inhibitor is drastically increased.

According to another embodiment of the present invention, after the soaking step in the decarburization annealing process, the steel sheet (strip) is treated in a gas atmosphere containing a gas having a nitriding capacity, such as $NH_3$, or after the decarburization annealing, the steel sheet is treated in a heat-treating furnace having a gas atmosphere containing a gas having a nitriding capacity, such as $NH_3$. Moreover, an ion nitriding process can be adopted. These processes can be adopted in combination.

The steel sheet in which the secondary recrystallization has been completed is subjected to purification annealing in a hydrogen atmosphere.

Still another embodiment of the present invention in which B and Ti are added in combination will now be described.

In this embodiment, 0.0020 to 0.0120% by weight of Ti is further added to the above-mentioned B-incorporated steel. The results obtained by adding Ti and B in combination are shown in FIG. 5.

More specifically, 50 kg of an ingot formed by adding 0.0010 to 0.0180% by weight of Ti and 0.0002 to 0.0090% by weight of B to a base steel comprising 0.048% by weight of C, 3.30% by weight of Si, 0.100% by weight of Mn, 0.008% by weight of S, 0.025% by weight of P, 0.032% by weight of Al and 0.0075 to 0.0092% by weight of N, with the balance comprising Fe and unavoidable impurities, is heated at 1150° C. and hot-rolled to obtain a hot-rolled sheet having a thickness of 2.0 mm. The hot-rolled sheet is annealed at 1120° C. for 3 minutes and then cold-rolled to a thickness of 0.20 mm, decarburization annealing is carried out at 850° C., and MgO containing ferro-manganese nitride is coated on the steel sheet. Then a secondary recrystallization annealing is carried out at 1200° C.

Figure 5:
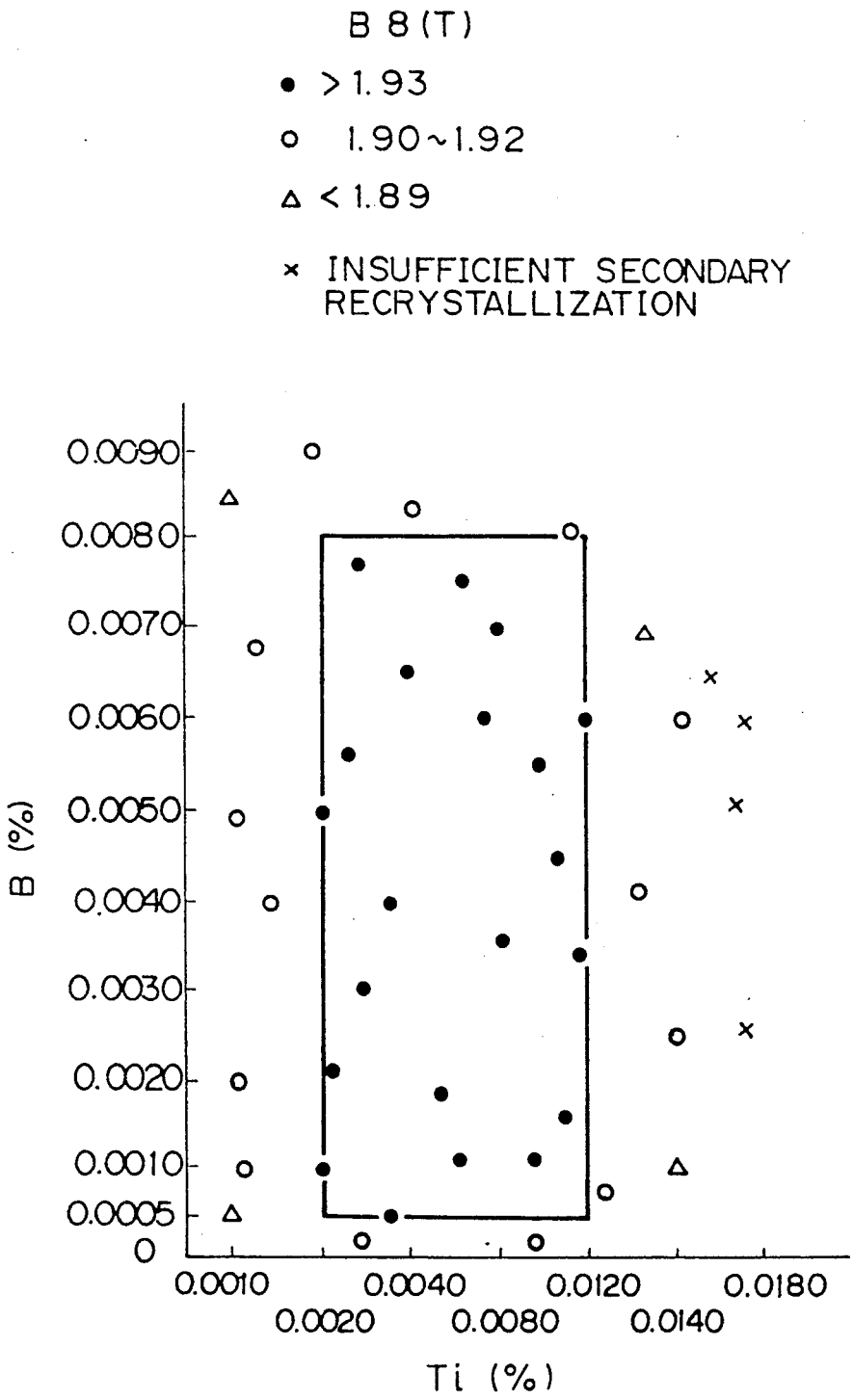
FIG. 5 is a diagram illustrating the flux density obtained by adding B and Ti in combination in another example of the present invention.

From the results shown in FIG. 5, it is seen that if 0.0020 to 0.0120% by weight of Ti and 0.0005 to 0.0080% by weight of B are added in combination, a product having a high flux density, i.e., a value B8 of at least 1.93 T, can be obtained. Therefore, in the present embodiment, the amount added of Ti is limited to 0.0020 to 0.0120% by weight.

In the preparation process of the present invention, which is characterized in that the inhibitor is formed and included in the steel sheet by nitriding the steel sheet at the step after completion of the final cold rolling, the indispensable requirement of the conventional techniques that the inhibitor precipitated at the step precedent to the final cold rolling step should be as fine as possible need not be satisfied. In the present invention, preferably the precipitate is larger, because the secondary recrystallization speed is controlled and the orientation degree in orientation {110}<001> is improved, for the following reason. Namely, as the temperature rises, fine precipitates disappear and cohere to large precipitates, due to the phenomenon generally known as Ostwald ripening. If this change occurs too early during the advance of secondary recrystallization, the secondary recrystallization speed cannot be smoothly controlled.

In the present invention, by an addition of B and Ti, BN and TiN are formed before the hot rolling step, and AlN is precipitated afterward. Accordingly, AlN as the main precipitate is relatively large and uniform. Little cohesion occurs in this large precipitate even if the temperature rises, and the secondary recrystallization is effectively controlled. Therefore, the shortage of a fine precipitate is covered by nitriding the steel sheet after the completion of cold rolling. Namely, the addition of B and Ti in the present invention exerts an effect in the process in which an inhibitor is formed and included in the steel after the completion of cold rolling. Namely, in the process of the present invention, to obtain a product having a high flux density, the size of primary recrystallization grains after decarburization annealing must be adjusted to a predetermined level.

For this purpose, an uneven size or dispersion of the precipitate before cold rolling is not preferred. It is considered that Ti and B form TiN and BN, which influence the precipitation and dispersion of AlN before decarburization annealing and act advantageously to adjust the grain size at the primary recrystallization of the decarburization annealing step. Furthermore, it is presumed that BN also acts as the inhibitor for a manifestation of the secondary recrystallization at the finish annealing, and is effective for the growth of crystal grains having an excellent orientation.

Rolling cracking of the steel of the present embodiment at the hot rolling step is compared with the case of steel having B alone incorporated therein.

Figure 6A:
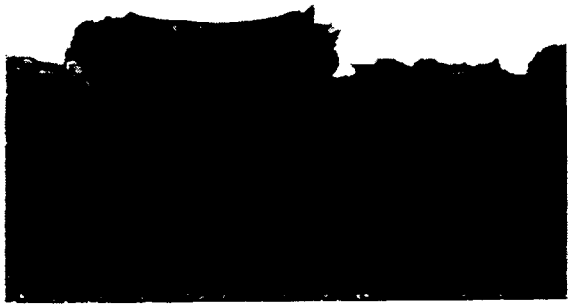
FIGS. 6-(*a*) and 6-(*b*) are photographs showing end portions of the hot-rolled sheet in the example shown in FIG. 5.
Figure 6B:
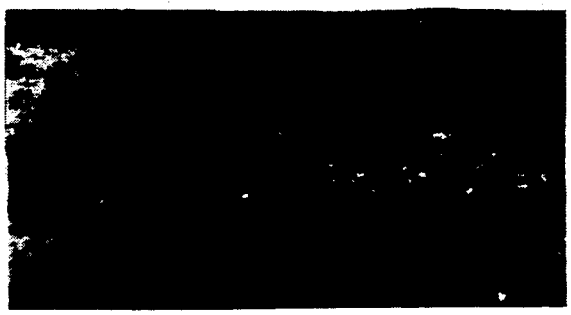

More specifically, 50 kg of an ingot comprising 0.053% of C, 3.35% of Si, 0.030% of P, 0.030% of Al, 0.0075% of N, 0.0039% of B, 0.0038% of Ti, 0.04 or 0.12% of Mn, and a variable amount of S is heated at 1360° C. or 1150° C. and hot-rolled, and cracking of end portions of the hot-rolled sheet is examined. It is found that, as in the steel having B alone incorporated therein, cracking is drastically reduced if the requirement of $Mn/S \geqq 4$ is satisfied, and especially, where the slab is heated at a low temperature of 1150° C. and MnS is not solid-dissolved, cracking does not substantially occur (the results are substantially the same as the results shown in FIG. 1). Note, FIGS. 6-(*a*) and 6-(*b*) are photographs showing the shapes of the end portions of hot-rolled plates described above. Namely, FIG. 6-(*a*) shows the results obtained when the Mn/S ratio is 2 and the slab-heating temperature is 1350° C., and FIG. 6-(*b*) shows the results obtained when the Mn/S ratio is 14 and the slab-heating temperature is 1350° C. (substantially the same results are obtained when the slab-heating temperature is 1150° C).

In the present embodiment directed to the combined addition of B and Ti, as described above, the intended effect is realized if the amount added of B is 0.0005 to 0.0080%. This can be also confirmed by the following experiment.

Figure 7:
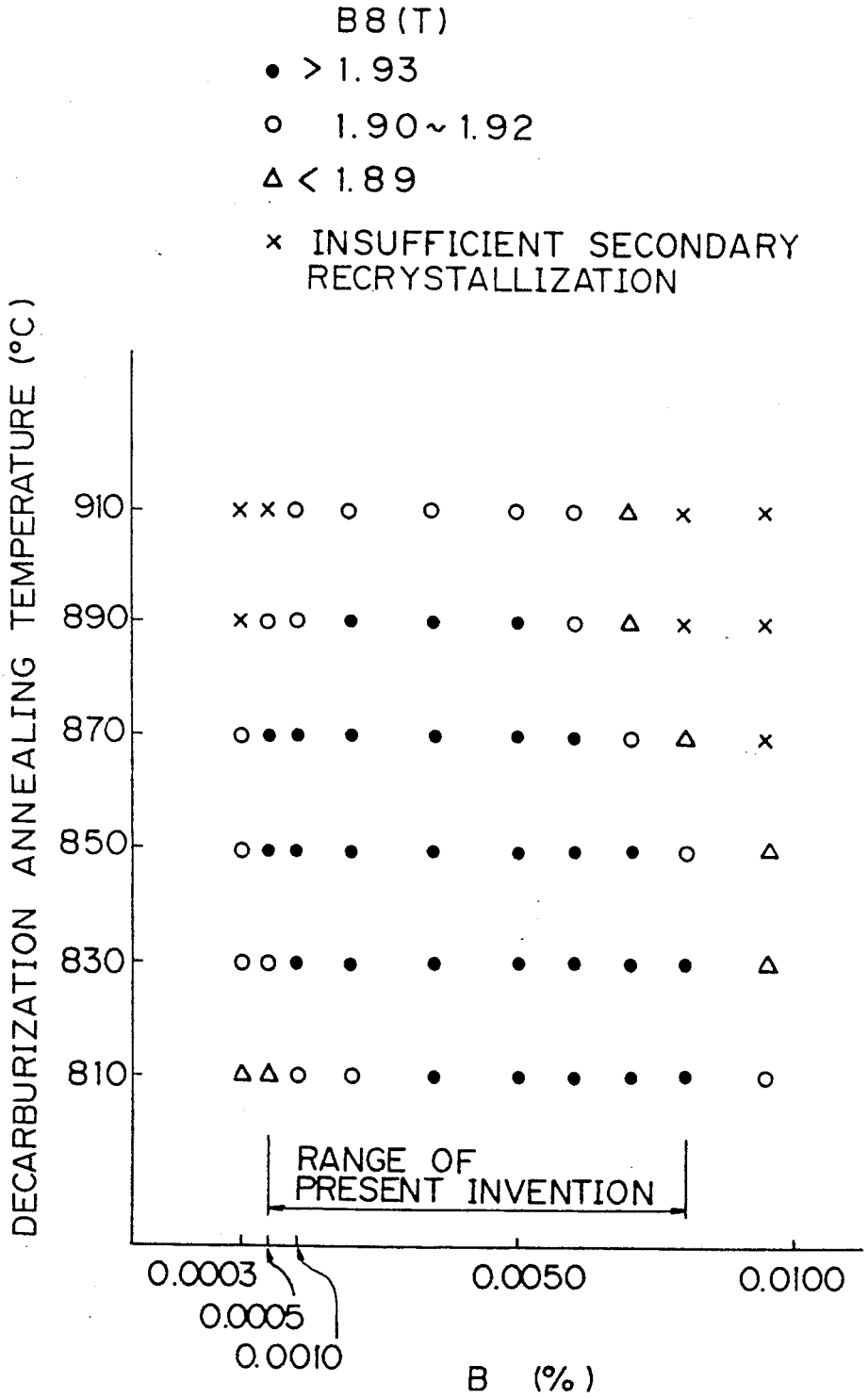
FIG. 7 is a diagram illustrating the relationship between the B content and decarburization annealing in the example shown in FIG. 5; and, FIGS. 8-(*a*) and 8-(*b*) are photographs illustrating the inhibitor-generating states in the steel sheet not subjected to the nitriding treatment and in the steel sheet subjected to the nitriding treatment, respectively.

More specifically, 50 kg of an ingot comprising 0.053% of C, 3.25% of Si, 0.14% of Mn, 0.007% of S, 0.0030% of Ti, 0.023% of P, 0.028% of Al, 0.0085% of N, and 0.0002 to 0.0095% of B, with the balance comprising Fe and unavoidable impurities, is heated at 1150° C. and hot-rolled to a thickness of 2.0 mm, and the hot-rolled sheet is annealed at 1120° C. for 3 minutes and cold-rolled to a thickness of 0.20 mm. Then, decarburization annealing is carried out at 810°, 830°, 850°, 870°, 890° or 910° C., MgO containing ferro-manganese nitride is coated, and secondary recrystallization annealing is carried out at 1200° C. The results are shown in FIG. 7. From the results shown in FIG. 7, it is seen that, if the decarburization annealing temperature is elevated, the flux density B8 is increased but at a low B content, fine grains are easily formed and the maximum value of B8 is small. It also is found that, if the B content is too high, a large value of B8 cannot be obtained, and a preferred B content is in the range of 0.0005 to 0.0080%, as where B alone is 0.0005 to 0.0080%. In this case, a high flux density B8 of at least 1.93T is obtained, and the effect of the combined addition of B and Ti is conspicuous.

The present invention will now be described in detail with reference to the following examples, that by no means limit the scope of the invention.

EXAMPLE 1

A slab obtained by casting a molten steel comprising 0.055% by weight of C, 3.50% by weight of Si, 0.031% by weight of P, 0.026% by weight of Al, 0.0077% by weight of N, and 0.0003% by weight (a), 0.0015% by weight (b), 0.0060% by weight (c) or 0.0100% by weight (d) of B was heated at 1195° C. and hot-rolled to obtain a hot-rolled sheet having a thickness of 2.3 mm. Then, the hot-rolled sheet was annealed at 1150° C. for 1 minute and cold-rolled to a thickness of 0.23 mm. Decarburization annealing was carried out in a wet hydrogen/nitrogen mixed atmosphere (75% of $H_2$ and 25% of $N_2$) at 830° C. for 2 minutes. The dew point of the atmosphere used was found to be 55° C. An annealing separator of MgO containing 4% by weight of ferro-manganese nitride was coated on the sheet surface, finish annealing was carried out by elevating the temperature to 1200° C. at a rate of 10° C./hr, and the sheet was maintained at this temperature for 20 hours. An atmosphere comprising 75% of $N_2$ and 25% of $H_2$ was used during the elevation of the temperature to 1200° C. and an atmosphere comprising 100% of $H_2$ was used while the steel sheet was maintained at 1200° C.

The flux densities of the obtained products were as shown below.

| Amount (%) of Added B | B8 (T) |
|---|---|
| 0.0003 | 1.91 |
| 0.0015 | 1.93 |
| 0.0060 | 1.94 |
| 0.0100 | 1.85 |

As apparent from the above results, an appropriate range of the B content existed.

EXAMPLE 2

An electromagnetic slab (A) comprising 0.050% by weight of C, 3.30% by weight of Si, 0.150% by weight of Mn, 0.025% by weight of P, 0.006% by weight of S, 0.028% by weight of Al, 0.0075% by weight of N, and 0.120% by weight of Cr, with the balance comprising Fe and unavoidable impurities, and an electric steel slab (B) formed by adding 0.0030% by weight of B to the above-mentioned composition, were heated at 1150° C. and hot-rolled to obtain hot-rolled sheets having a thickness of 1.6, 2.0, 2.5, 2.8 or 3.5 mm.

These hot-rolled sheets were annealed at 1120° C. for 2 minutes and final cold rolling was conducted once to a final thickness of 0.29 mm. Then, decarburization annealing was carried out at 850° C. for 150 seconds in a wet hydrogen/nitrogen mixed gas having a dew point of +60° C., and the steels were coated with an annealing separator of MgO containing 3% by weight of $TiO_2$ and 5% by weight of ferro-manganese nitride.

The sheets were heated to 1200° C. at a temperature-elevating rate of 10° C./hr and maintained at 1200° C. for 20 hours to effect finish annealing. A mixed gas comprising 25% of $N_2$ and 75% of $H_2$ was used as the atmosphere during the elevation of the temperature, and a gas comprising 100% of $H_2$ was used as the atmosphere while the sheets were maintained at 1200° C.

Figure 3:
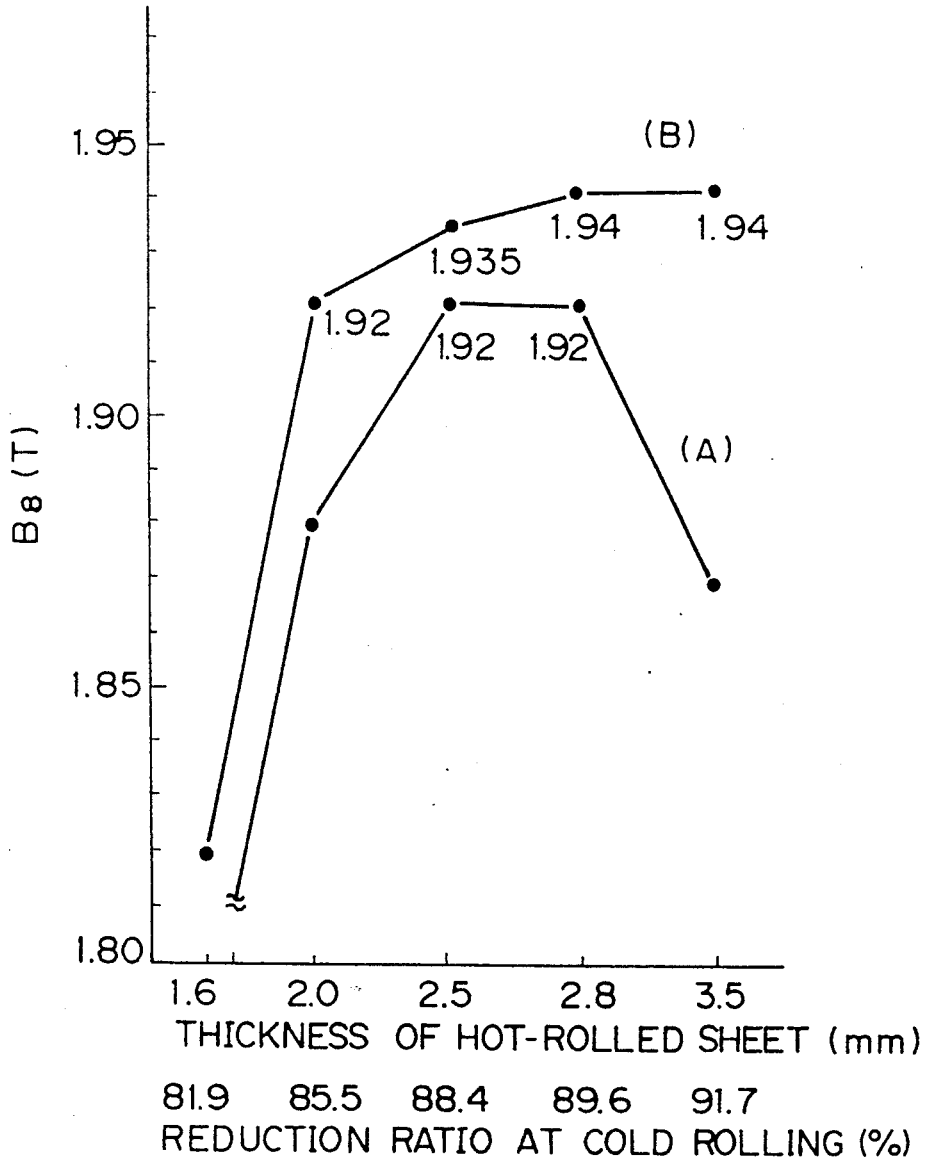
FIG. 3 is a diagram illustrating the relationship between the thickness of the hot-rolled sheet and the flux density [B8(T)] of the product, observed when the final thickness is adjusted to 0.29 mm with respect to the grain oriented electric steel material (A) having no B incorporated therein and the grain oriented electric steel material (B) having 0.0030% of B incorporated therein in the same example.

The results are shown in FIG. 3.

As apparent from FIG. 3, in the case of material (A), a high flux density was obtained only when the thickness of the hot-rolled sheet was 2.5 or 2.8 mm, but in the case of material (B), a high flux density was obtained when the thickness of the hot-rolled sheet was any of 2.0, 2.5, 2.8 and 3.5 mm and the magnetic characteristics of the product were stable at high levels even if the reduction ratio at the cold rolling step was changed.

EXAMPLE 3 hot-rolled sheets having the same composition and thickness as described in Example 2 were prepared and annealed at 1120° C. for 2 minutes, and cold rolling was conducted once to a final thickness of 0.20 mm.

Then, decarburization annealing was carried out at 850° C. for 90 seconds in a wet hydrogen/nitrogen atmosphere, an annealing separator was coated, and final annealing was carried out under the same conditions as described in Example 2.

Figure 4:
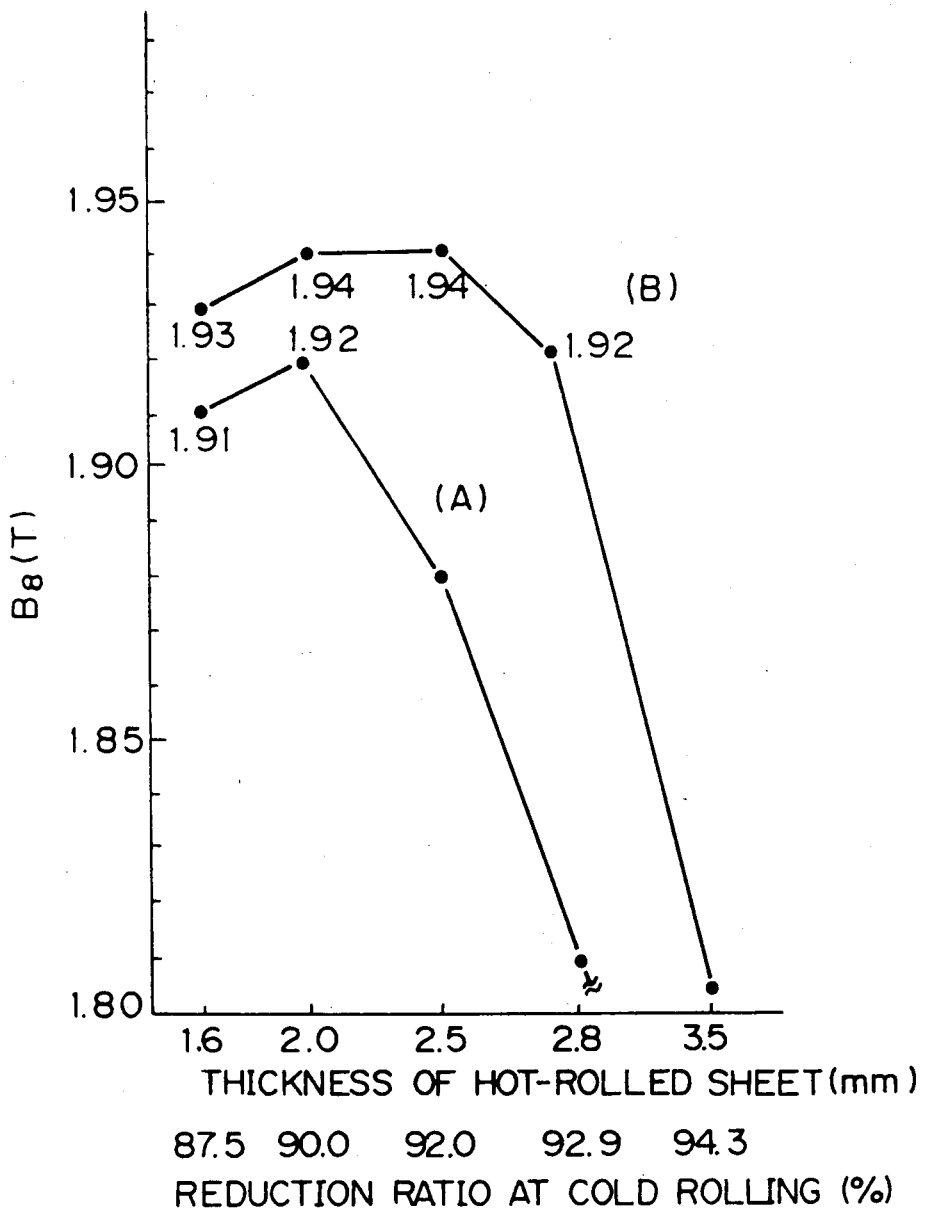
FIG. 4 is a diagram illustrating the relationship between the thickness (gauge) of the hot-rolled sheet and the flux density [B8(T)] of the product, observed when the final thickness is adjusted to 0.20 mm with respect to the grain oriented electric steel material (A) having no B incorporated therein and the grain oriented electric steel material (B) having 0.0030% of B incorporated therein in the same example.

The results are shown in FIG. 4.

As apparent from the results shown in FIG. 4, in the case of material (A), a high flux density was obtained only when the thickness of the hot-rolled sheet was 1.6 or 2.0 mm, but in the case of material (B), a high flux density was obtained when the thickness of the hot-rolled sheet was any of 1.6, 2.0, 2.5 and 2.8 mm.

EXAMPLE 4

A slab comprising 0.055% by weight of C, 3.28% by weight of Si, 0.15% by weight of Mn, 0.006% by weight of S, 0.025% by weight of P, 0.027% by weight of Al, 0.0077% by weight of N, and 0.0003 or 0.0020% by weight of B was heated at 1150° C. and hot-rolled to obtain a hot-rolled sheet having a thickness of 2.6 mm. The scale was scraped and the sheet was cold-rolled to a thickness of 1.8 mm. The cold-rolled sheet was annealed at 1100° C. for 2 minutes and was then pickled, the steel sheet was cold-rolled to a thickness of 0.15 mm, and decarburization annealing was carried out at 840° C. for 70 seconds. Then, the steel sheet was coated with an annealing separator of MgO containing 3% by weight of ferro-manganese nitride, was heated to 1200° C. at a temperature-elevating rate of 8° C./hr, and annealed at 1200° C. for 20 hours. A mixed gas comprising 50% of $N_2$ and 50% of $H_2$ was used as the atmosphere during the elevation of the temperature and a gas comprising 100% of $H_2$ was used as the atmosphere at the soaking step at 1200° C.

The magnetic characteristics and crystal grain size of the products were as shown below.

| Amount (%) of Added B | B8 (T) | Crystal Grain Size (ASTM × 1) |
|---|---|---|
| 0.0003 | 1.88 | 4.5 |
| 0.0020 | 1.92 | 3.5 |

EXAMPLE 5

A slab obtained by adding 0.04% by weight (a), 0.010% by weight (b) or 0.018% by weight (c) of S to a molten steel comprising 0.052% by weight of C, 3.30% by weight of Si, 0.14% by weight of Mn, 0.033% by weight of P, 0.027% by weight of Al, 0.0075% by weight of N, and 0.0020% by weight of B, with the balance comprising Fe and unavoidable impurities, was heated at 1195° C. and hot-rolled to obtain a hot-rolled sheet having a thickness of 2.0 mm. The hot-rolled sheet was annealed at 1120° C. for 2 minutes and at 900° C. for 1 minute, and the sheet was pickled and cold-rolled to a thickness of 0.20 mm. Then, decarburization annealing was carried out at 850° C. for 100 seconds in wet hydrogen, the sheet was coated with an annealing separator of MgO containing 3% by weight of MnN, and finish annealing was carried out at 1200° C. for 20 hours. At the finish annealing step, a mixed gas comprising 25% of $N_2$ and 75% of $H_2$ was used as the atmosphere gas during the elevation of the temperature, and a gas comprising 100% of $H_2$ was used as the atmosphere during the soaking at 1200° C. The flux densities of the obtained sheets were as shown below.

| S Content (% by weight) | B8 (T) |
|---|---|
| 0.004 | 1.94 |
| 0.010 | 1.93 |
| 0.018 | 1.88 |

EXAMPLE 6

A slab obtained by adding 0.0050% by weight (a), 0.0100% by weight (b) or 0.0200% by weight (c) of Se to a molten steel comprising 0.045% by weight of C, 3.50% by weight of Si, 0.16% by weight of Mn, 0.035% by weight of P, 0.028% by weight of Al, 0.0080% by weight of N, and 0.0025% by weight of B, with the balance comprising Fe and unavoidable impurities, was heated at 1150° C. and hot-rolled to obtain a hot-rolled sheet having a thickness of 2.0 mm. The hot-rolled sheet was annealed at 1150° C. for 2 minutes and at 900° C. for 2 minutes, and the steel sheet was quenched, pickled and cold-rolled to a final thickness of 0.20 mm.

Subsequently, decarburization annealing was carried out at 830° C. for 90 seconds, and an annealing separator of MgO comprising 5% by weight of ferro-manganese nitride was coated on the steel sheet surface.

Then, the steel sheet was heated to 1200° C. at a temperature-elevating rate of 10° C./hr, and was maintained at 1200° C. for 20 hours to effect finish annealing. A mixed gas comprising 25% of $N_2$ and 75% of $H_2$ was used as the atmosphere during the elevation of the temperature to 1200° C., and a gas comprising 100% of $H_2$ was used as the atmosphere during the soaking.

The magnetic characteristics of the obtained sheets were as shown below.

| Se Content (%) | B8 (T) |
|---|---|
| 0.0050 | 1.93 |
| 0.0120 | 1.92 |
| 0.0200 | 1.89 |

As apparent from the above results, if the Se content was too high, a product having a high flux density was not obtained.

EXAMPLE 7

A slab comprising 0.048% by weight of C, 3.30% by weight of Si, 0.145% by weight of Mn, 0.008% by weight of S, 0.030% by weight of Al, 0.0075% by weight of N, and 0.0024% by weight of B, with the balance comprising Fe and unavoidable impurities, was heated at 1100° C. and hot-rolled to obtain a hot-rolled sheet having a thickness of 2.3 mm.

The hot-rolled sheet was subjected to the following annealing conditions: (1) not annealed, (2) annealed at 900° C. for 6 minutes, or (3) annealed at 1130° C. for 2 minutes and 900° C. for 1 minute and then quenched.

Then, cold rolling was conducted once to a thickness of 0.30 mm and decarburization annealing was carried out at 840° C. for 180 seconds in a wet hydrogen/nitrogen mixed gas. The sheet was then coated with an annealing separator of MgO containing 5% by weight of ferro-manganese nitride and finish annealing was carried out at 1200° C. for 20 hours. The temperature-elevating rate was 15° C./hr during the elevation of the temperature and a mixed gas comprising 25% of nitrogen and 75% of hydrogen was used as the atmosphere. A gas comprising 100% of hydrogen was used as the atmosphere during the soaking at 1200° C.

The magnetic characteristics of the obtained sheets were as shown below.

| Hot-Rolled Sheet-Annealing Condition | B8 (T) |
|---|---|
| (1) | 1.89 |
| (2) | 1.92 |
| (3) | 1.93 |

EXAMPLE 8

A slab obtained by adding B in an amount shown below to a silicon steel comprising 0.055% by weight of C, 3.3% by weight of Si, 0.14% by weight of Mn, 0.030% by weight of P, 0.007% by weight of S, 0.0040% by weight of Ti, 0.12% by weight of Cr, 0.030% by weight of Al, and 0.0080% by weight of N, with the balance comprising Fe and unavoidable impurities, was heated at 1150° C. and hot-rolled to obtain a hot-rolled sheet having a thickness of 2.0 mm. The hot-rolled sheet was annealed at 1100° C. for 2 minutes and cold-rolled once to a final thickness of 0.20 mm. Then, decarburization annealing was carried out at 1100° C. for 90 seconds in a wet hydrogen/nitrogen mixed gas having a dew point of 60° C. The steel sheet was then coated with (a) an anneal-coating agent of MgO containing 3% by weight of $TiO_2$ and 5% by weight of ferro-manganese nitride or (b) an anneal-separator of MgO containing by weight 3% of $TiO_2$, and the sheet was heated to 1200° C. at a temperature-elevating rate of 10° C./hr and annealed at 1200° C. for 20 hours. A mixed gas comprising 25% of $N_2$ and 75% of $H_2$ was used as the atmosphere during the elevation of the temperature to 1200° C., and a gas comprising 100% of $H_2$ was used as the atmosphere during the soaking at 1200° C. When ferro-manganese nitride acting as the nitriding source was added to the annealing separator, a secondary recrystallization occurred each case and a very high flux density was obtained in each of the B-incorporated materials. In contrast, if ferro-manganese nitride was not added, the secondary recrystallization was insufficient in each case. The following results were obtained.

| | B8 (T) | |
|---|---|---|
| B Content (ppm) | Anneal-Separating Agent (a) | Anneal-Separating Agent (b) |
| 0 | 1.91 | fine grains |
| 10 | 1.93 | fine grains |
| 30 | 1.96 | fine grains |
| 50 | 1.95 | fine grains |

EXAMPLE 9

A slab of a silicon steel comprising 0.048% by weight of C, 3.25% by weight of Si, 0.12% by weight of Mn, 0.025% by weight of P, 0.14% by weight of Cr, 0.0030% by weight of Ti, 0.028% by weight of Al, 0.0070% by weight of N, 0.0030% by weight of B and 0.003% by weight (a), 0.009% by weight (b) or 0.018% by weight (c) of S, with the balance of comprising Fe and unavoidable impurities, was heated at 1200° C. and hot-rolled to obtain a hot-rolled sheet having a thickness of 1.8 mm. The hot-rolled sheet was annealed at 1100° C. for 2 minutes and cold-rolled once to a final thickness of 0.18 mm. Decarburization annealing was carried out at 830° C. for 90 seconds in a wet hydrogen/nitrogen mixed gas having a dew point of 55° C., and the sheet was coated with an annealing separator of MgO containing 7% by weight of ferro-manganese nitride. The temperature was elevated to 1200° C. at a rate of 15° C./hr and annealing was conducted at 1200° C. for 20 hours. The atmosphere gases were the same as those used in Example 1, and the following results were obtained.

| Amount (%) of Added S | B8 (T) |
|---|---|
| 0.003 | 1.95 |
| 0.009 | 1.95 |
| 0.018 | 1.88 |

If the S content was too high, a high flux density could not be obtained.

EXAMPLE 10

A slab formed by adding 0.0050% by weight (a), 0.0100% by weight (b) or 0.0200% by weight (c) of Se to a molten steel comprising 0.045% by weight of C, 3.50% by weight of Si, 0.16% by weight of Mn, 0.035% by weight of P, 0.028% by weight of Al, 0.0080% by weight of N, 0.0040% by weight Ti and 0.0035% by weight of B, with the balance comprising Fe and unavoidable impurities, was heated at 1150° C. and hot-rolled to obtain a hot-rolled sheet having a thickness of 2.0 mm.

The hot-rolled sheet was annealed at 1150° C. for 2 minutes and at 900° C. for 2 minutes, quenched, pickled and cold-rolled to a thickness of 0.20 mm. Decarburization annealing was carried out at 830° C. for 90 seconds and the sheet was coated with an annealing separator of MgO containing 5% by weight of ferro-manganese nitride. The sheet was heated to 1200° C. at a rate of 10° C./hr and annealed at 1200° C. for 20 hours.

A mixed gas comprising 50% of $N_2$ and 50% of $H_2$ was used as the atmosphere during the elevation of the temperature and a gas comprising 100% of $H_2$ was used as the atmosphere during the soaking.

The magnetic characteristics of the obtained products were as shown below.

| Amount (%) of Added Se | B8 (T) |
|---|---|
| 0.0050 | 1.95 |
| 0.0120 | 1.94 |
| 0.0200 | 1.89 |

If the Se content was too high, a high flux density could not be obtained.

EXAMPLE 11

A slab (a) comprising 0.045% by weight of C, 3.30% by weight of Si, 0.150% by weight of Mn, 0.009% by weight of S, 0.030% by weight of P, 0.031% by weight of Al, 0.0070% by weight of N, and 0.0060% by weight of Ti, with the balance comprising Fe and unavoidable impurities, and a slab (b) formed by adding 0.0035% by weight of B to the above composition, were heated at 1100° C. and hot-rolled to obtain hot-rolled sheets having a thickness of 2.3 mm.

The hot-rolled sheets were annealed under the following conditions: (1) not annealed, (2) annealed at 900° C. for 5 minutes and quenched, or (3) annealed at 1150° C. for 2 minutes and at 900° C. for 2 minutes and quenched.

Cold rolling was carried out once to a final thickness of 0.30 mm and decarburization annealing was carried out at 830° C. for 150 seconds in a wet hydrogen/nitrogen gas having a dew point of 65° C. Then, the sheets were coated with annealing separator of MgO containing $TiO_2$, and finish annealing was carried out by heating the sheets to 1200° C. at a rate of 15° C./hr and maintaining them at 1200° C. for 20 hours.

A mixed gas comprising 25% of nitrogen and 75% of hydrogen, in which 10 ppm of $NH_3$ gas incorporated, was used as the atmosphere during the elevation of the temperature and hydrogen gas alone was used at the soaking at 1200° C. for purification.

The magnetic characteristics (B8) of the obtained products were as shown below.

| Slab | B Content (%) | Annealing Condition (1) | (2) | (3) |
|---|---|---|---|---|
| (a) | <0.0005 | 1.87 T | 1.90 T | 1.92 T |
| (b) | 0.0035 | 1.90 T | 1.94 T | 1.95 T |

In the B-incorporated material, a larger value of B8 was obtained than in the B-free material, regardless of whether or not annealing of the hot-rolled sheet was effected.

EXAMPLE 12

A slab comprising 0.056% by weight of C, 3.40% by weight of Si, 0.130% by weight of Mn, 0.005% by weight of S, 0.030% by weight of P, 0.027% by weight of Al, 0.0075% by weight of N, 0.0030% by weight of Ti, and 0.0042% by weight of B, with the balance comprising Fe and avoidable impurities, was heated at 1150° C. and hot-rolled to obtain a hot-rolled sheet having a thickness of 2.5 or 1.6 mm. The hot-rolled sheet having a thickness of 2.5 mm was pickled and cold-rolled to a thickness of 1.6 mm. This cold-rolled sheet and the hot-rolled sheet having a thickness of 1.6 mm were annealed at 1120° C. for 2.5 minutes, quenched, and cold-rolled to a thickness of 0.150 mm. Decarburization annealing was carried out at 830° C. for 70 seconds, and the sheets were coated with an annealing separator of MgO containing $TiO_2$ and MnN, and finish annealing was carried out at 1200° C. for 20 hours.

A mixed gas comprising 25% of nitrogen and 75% of hydrogen was used as the atmosphere during the elevation of the temperature, and hydrogen gas alone was used as the atmosphere at the soaking at 1200° C. for purification. The magnetic characteristics of the obtained products were as shown below.

| | Two-Rolling Method (hot-rolled sheet thickness = 2.5 mm) | One-Rolling-Method (hot-rolled sheet thickness = 1.6 mm) |
|---|---|---|
| B8 (T) | 1.94 | 1.95 |
| Crystal Grain Size (ASTM × 1) | 4 | 2 |

As apparent from the foregoing description, according to the present invention, even by the low-temperature slab heating as customarily adopted for ordinary steels, a unidirectional electromagnetic steel sheet having a high flux density can be obtained with much reduced rolling cracking, and the present invention is very valuable from the industrial viewpoint.

We claim:

1. A process for the preparation of a grain-oriented electrical steel sheet having a high flux density, which comprises heating a slab at a slab-heating temperature of lower than 1200° C., said slab comprising 1.5 to 4.8% by weight of Si, 0.012 to 0.050% by weight of Al, 0.0010 to 0.120% by weight of N, 0.0005 to 0.0080% by weight of B, up to 0.012% by weight of at least one member selected from S and Se, and Mn in an amount of up to 0.45% by weight, which satisfies the requirement of $Mn/(S+Se) \geqq 4.0$ (weight ratio), with the balance comprising Fe and unavoidable impurities, hot-rolling the slab, performing cold rolling once or at least twice with intermediate annealing to obtain a final thickness, performing decarburization annealing in a wet hydrogen atmosphere, coating an annealing separator on the steel sheet surface, performing finish annealing for secondary recrystallization and purification of the steel, and performing a nitriding treatment of the steel sheet during the period of from the point of termination of final cold rolling to the point of initiation of secondary recrystallization at the finish annealing step.

2. A process for the preparation of a grain-oriented electrical steel sheet having a high flux density, which comprises heating a slab at a slab-heating temperature of lower than 1200° C., said slab comprising 1.5 to 4.8% by weight of Si, 0.012 to 0.050% by weight of Al, 0.0020 to 0.0120% by weight of Ti, 0.0010 to 0.0120% by weight of N, 0.0005 to 0.0080% by weight of B, up to 0.012% by weight of at least one member selected from S and Se, and Mn in an amount of up to 0.45% by weight, which satisfies the requirement of $Mn/(S+Se) \geqq 4.0$ (weight ratio), with the balance comprising Fe and unavoidable impurities, hot-rolling the slab, performing cold rolling once or at least twice with intermediate annealing to obtain a final thickness, performing decarburization annealing in a wet hydrogen atmosphere, coating an annealing separator on the steel sheet surface, performing finish annealing for secondary recrystallization and purification of the steel, and performing a nitriding treatment of the steel sheet during the period of from the point of termination of final cold rolling to the point of initiation of secondary recrystallization at the finish annealing step.

3. A process according to claim 1, wherein the nitriding treatment is carried out during the temperature elevation period at the final annealing step.

4. A process according to claim 2, wherein the nitriding treatment is carried out during the temperature elevation period at the final annealing step.

5. A process according to claim 1, wherein a compound having a nitriding capacity is incorporated in the annealing separator.

6. A process according to claim 2, wherein a compound having a nitriding capacity is incorporated in the annealing separator.

7. A process according to claim 1, wherein a gas having a nitriding capacity is incorporated in an atmosphere gas at the final annealing step.

8. A process according to claim 2, wherein a gas having a nitriding capacity is incorporated in an atmosphere gas at the final annealing step.

9. A process according to claim 1, wherein the nitriding treatment is performed in an atmosphere of a gas having a nitriding capacity after soaking at the decarburization annealing step.

10. A process according to claim 2, wherein the nitriding treatment is performed in an atmosphere of a gas having a nitriding capacity after soaking at the decarburization annealing step.

11. A process according to claim 1, wherein the final thickness is 0.10 to 0.23 mm.

12. A process according to claim 2, wherein the final thickness is 0.10 to 0.23 mm.

* * * * *

UNITED STATES PATENT AND TRADEMARK OFFICE

CERTIFICATE OF CORRECTION

PATENT NO. : 4,994,120

DATED : February 19, 1991

INVENTOR(S) : Nobuyuki TAKAHASHI, et al.

It is certified that error appears in the above-identified patent and that said Letters Patent is hereby corrected as shown below:

On the Title page

ABSTRACT, line 2, change "desnity" to --density--.

ABSTRACT, line 9, change "0.005" to --0.0005--.

Column 1, line 46, change "as possible a flux density" to --a flux density as possible--.

Column 1, line 67, change "azumith" to --azimuth--.

Column 2, line 16, change "organical" to --organic--.

Column 2, line 24, change "221" to --212--.

Column 7, lines 14 and 15, change "temperature" to --temperatures--.

Column 7, line 42, change "highest" to --higher--.

Column 16, line 12, between "gas" and "incorporated," insert --was--.

UNITED STATES PATENT AND TRADEMARK OFFICE

CERTIFICATE OF CORRECTION

PATENT NO. : 4,994,120

DATED : February 19, 1991

INVENTOR(S) : Nobuyuki Takahashi, et. al.

It is certified that error appears in the above-identified patent and that said Letters Patent is hereby corrected as shown below:

Column 17, line 9, change "0.120" to --0.0120--.

Signed and Sealed this

Twenty-third Day of February, 1993

*Attest:*

STEPHEN G. KUNIN

*Attesting Officer*

*Acting Commissioner of Patents and Trademarks*